US007874650B2

(12) United States Patent
Baek et al.

(10) Patent No.: US 7,874,650 B2
(45) Date of Patent: Jan. 25, 2011

(54) PIEZO-ELECTRIC TYPE PAGE WIDTH INKJET PRINTHEAD AND IMAGE FORMING APPARATUS HAVING THE SAME

(75) Inventors: Seok-soon Baek, Suwon-si (KR); Seung-joo Shin, Seoul (KR); Seong-jin Kim, Seongnam-si (KR)

(73) Assignee: Samsung Electro-Mechanics Co., Ltd, Suwon-si (KR)

( * ) Notice: Subject to any disclaimer, the term of this patent is extended or adjusted under 35 U.S.C. 154(b) by 831 days.

(21) Appl. No.: 11/780,183

(22) Filed: Jul. 19, 2007

(65) Prior Publication Data

US 2008/0136873 A1 Jun. 12, 2008

(30) Foreign Application Priority Data

Dec. 12, 2006 (KR) ..... 10-2006-0126411

(51) Int. Cl.
*B41J 2/045* (2006.01)

(52) U.S. Cl. ..... 347/68

(58) Field of Classification Search ..... 347/68, 347/70–72

See application file for complete search history.

(56) References Cited

U.S. PATENT DOCUMENTS 6,701,593 B2 * 3/2004 Lin et al. ..... 29/25.35
7,121,650 B2 * 10/2006 Chung et al. ..... 347/68

* cited by examiner

*Primary Examiner*—An H Do
(74) *Attorney, Agent, or Firm*—Stanzione & Kim LLP

(57) ABSTRACT

A piezo-electric type page width inkjet printhead includes an intermediate substrate that includes a pressure chamber to be filled with ink to be ejected, a manifold connected to an ink entrance hole to store ink that flows in through the ink entrance hole, a restrictor to connect the manifold to one end of the pressure chamber, and a damper formed through the intermediate substrate corresponding to the other end of the pressure chamber, a lower substrate including a nozzle formed through a portion of the lower substrate, which corresponds to the damper, to eject the ink, an upper substrate formed on the intermediate substrate to seal an upper side of the pressure chamber, and a piezoelectric actuator formed on the upper substrate to generate a driving power to the pressure chamber to eject the ink through the nozzle, wherein the intermediate substrate includes a both-sided copper clad laminate plate including an upper copper film and a lower copper film that are respectively formed on top and bottom surfaces of the laminate plate.

15 Claims, 4 Drawing Sheets

PIEZO-ELECTRIC TYPE PAGE WIDTH INKJET PRINTHEAD AND IMAGE FORMING APPARATUS HAVING THE SAME

CROSS-REFERENCE TO RELATED APPLICATIONS

This application claims the benefit of Korean Patent Application No. 10-2006-0126411, filed on Dec. 12, 2006, in the Korean Intellectual Property Office, the disclosure of which is incorporated herein in its entirety by reference.

BACKGROUND OF THE INVENTION

1. Field of the Invention

The present general inventive concept relates to a piezo-electric type page width inkjet printhead, and more particularly, to a piezo-electric type page width inkjet printhead in which a copper clad laminate (CCL) substrate is used, and an image forming apparatus having the same.

2. Description of the Related Art

Generally, an inkjet printhead or a shuttle type printhead (hereinafter referred to as 'shuttle type printhead') is spaced a predetermined distance from a top surface of a sheet of paper. The shuttle type printhead forms an image on the paper by ejecting ink onto the paper while reciprocating in a perpendicular direction (the width direction of the paper) to the feeding direction of the paper. Although the shuttle type printhead can realize color printing having high quality, a printing speed of the shuttle type printhead is slow.

Unlike the shuttle type printhead reciprocating in the width direction of the paper, a recently-developed printhead, such as a line printing type printhead, includes a nozzle unit having a length corresponding to the width of paper in order to realize high-speed printing. Since the line printing type printhead ejects ink onto a top surface of fed paper from a fixed position, the line printing type printhead can print images at a high speed using a simple driving unit.

Some examples of the line printing type printhead are an array printhead and a page width printhead.

The array printhead is assembled by attaching a plurality of printheads to a body thereof. However, it is difficult to assemble the printheads in terms of process, and thus, the manufacturing costs of the array print head increase.

The page width printhead is manufactured using a single printhead as opposed to the array printhead, and thus, an assembling process is not required. However, in order to manufacture a large-area page width printhead, micromachining technology having a high degree of difficulty in terms of manufacturing is used. Accordingly, the large-area page width printhead is costly.

Accordingly, the following conditions are required in manufacturing a page width printhead.

First, a large-area process should be realized. A printhead is manufactured by using one chip having a diameter of eight inches or more, and thus, costs for assembling the printhead can not be removed.

Second, manufacturing costs should be reduced using simple and well arranged manufacturing processes.

Third, a circuit and a structure should be easily integrated. Since the number of nozzles is increased, the structure and the circuit should be easily integrated and costs for integration should be reduced.

SUMMARY OF THE INVENTION

The present general inventive concept provides a piezo-electric type page width inkjet printhead in which an integrated nozzle and circuit can be manufactured using a large-area process with low manufacturing costs, and an image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a piezo-electric type page width inkjet printhead including an intermediate substrate comprising a pressure chamber formed thereon to be filled with ink, a manifold connected to an ink entrance hole to store ink that flows in through the ink entrance hole, a restrictor to connect the manifold to one end of the pressure chamber, and a damper formed through the intermediate substrate corresponding to the other end of the pressure chamber, a lower substrate comprising a nozzle formed through a portion of the lower substrate, which corresponds to the damper, to eject ink, an upper substrate formed on the intermediate substrate and sealing an upper side of the pressure chamber, and a piezo-electric actuator formed on the upper substrate to generate a driving power to the pressure chamber to eject the ink through the nozzle, wherein the intermediate substrate comprises a both-sided copper clad laminate plate comprising an upper copper film and a lower copper film that are respectively formed on top and bottom surfaces of a laminate plate.

The foregoing and/or other aspects and utilities of the present general inventive concept may also be achieved by providing a piezo-electric type page width inkjet printhead including a lower substrate having a nozzle, an intermediate substrate formed of a laminate plate and a film and having an ink flowing channel, an upper substrate, and a piezoelectric actuator formed on the upper substrate to generate a driving power to the ink flowing channel to eject the ink through the nozzle.

The laminate plate may include a both-sided copper clad laminate plate.

The film may include a copper film.

The laminate plate may include a both-sided copper clad laminate plate; and the film may include a copper film.

The laminate plate may be formed of a first material, the film may be formed of a second material attached to the laminate plate to form the intermediate substrate, and the ink flowing channel may include a manifold, a restrictor, a pressure chamber, and a damper which are formed in corresponding ones of the laminate plate and the film.

The laminate plate may be formed of a first material, the film may be formed of a second material attached to the laminate plate to form the intermediate substrate, and the upper substrate and the lower substrate are formed of a third material different from the first material and the second material.

The film may include an upper film formed between the upper substrate and the laminate plate, and a lower film formed between the laminate plate and the lower substrate.

The nozzle may include a plurality of nozzles formed in the lower substrate, the piezoelectric actuator may include a plurality of piezoelectric actuators formed on the upper substrate, and the ink flowing channel may include a plurality of ink flowing channels formed in the laminate plate and the film of the intermediate substrate and disposed between corresponding ones of the plurality of nozzles and the plurality of piezoelectric actuators.

The laminate plate and the film of the intermediate substrate may be attached to each other and disposed between the lower substrate and the upper substrate to form the ink flowing channel.

The ink flowing channel may include a pressure chamber, and the film may be disposed between the laminate plate and the upper substrate to define the pressure chamber with the upper substrate and the laminate plate.

The ink flowing channel may include a pressure chamber, and the film may be disposed between the laminate plate and the upper substrate and includes a cutout portion to correspond to the pressure chamber.

The ink flowing channel may include a damper, and the laminate plate may include a cutout portion to correspond to the damper.

The ink flowing channel may include a restrictor; and the laminate plate may include a cutout portion to correspond to the restrictor.

The ink flowing channel may include a manifold, the laminate may include a first cutout portion, and the film may include a second cutout portion to define the manifold with the first cutout portion.

The foregoing and/or other aspects and utilities of the present general inventive concept may also be achieved by providing an image forming apparatus including an inkjet printhead unit having a lower substrate having a nozzle, an intermediate substrate formed of a laminate plate and a film and having an ink flowing channel, an upper substrate formed on the intermediate substrate, and a piezoelectric actuator formed on the upper substrate to generate a driving power to the ink flowing channel to eject the ink through the nozzle, a medium driver to feed a printing medium toward the inkjet printhead unit, and a controller to control the inkjet printhead unit and the medium driver to form an image on the fed printing medium.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
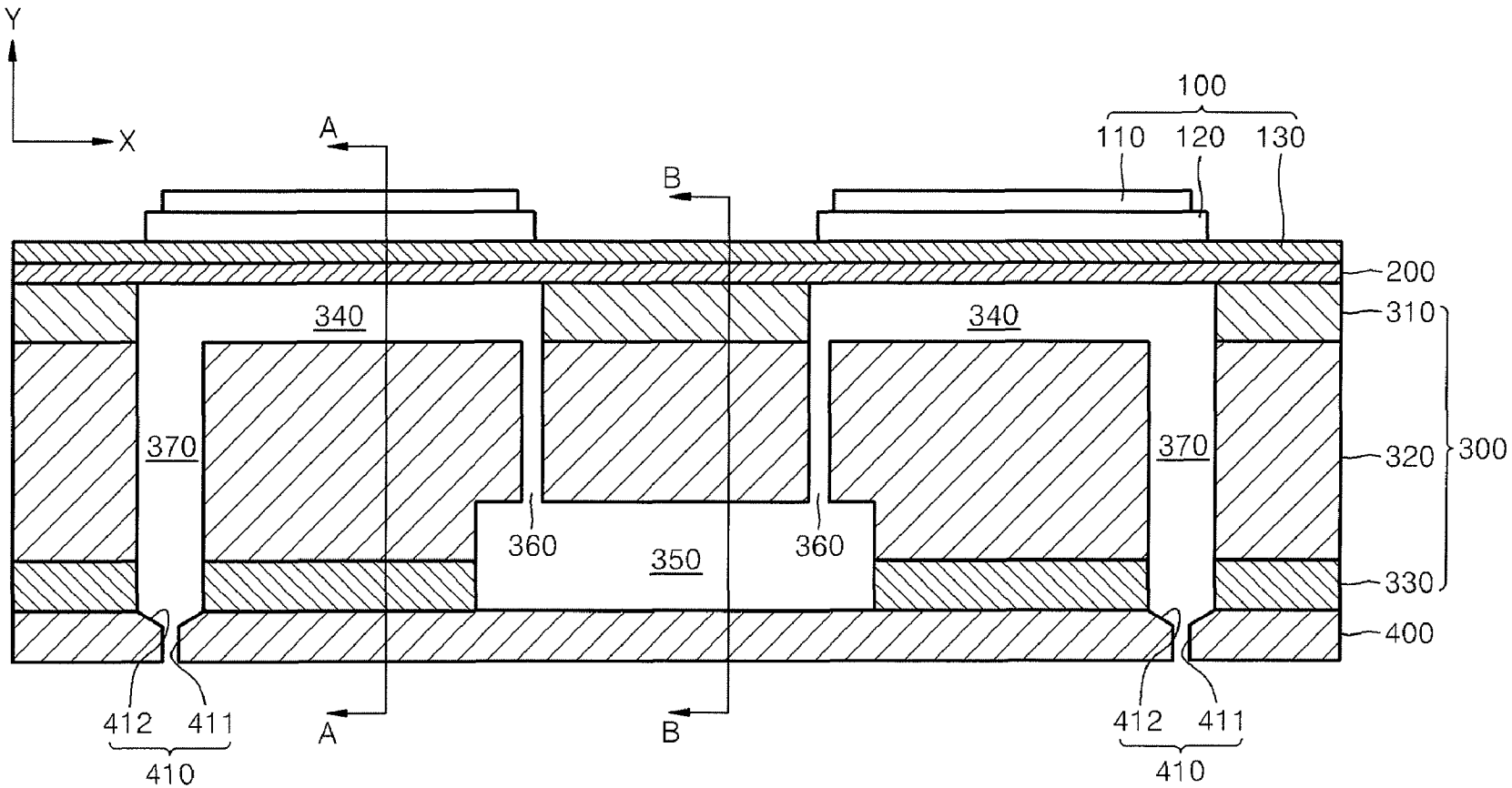
FIG. 1 is a cross-sectional view illustrating a piezo-electric type page width inkjet printhead taken along a lengthwise direction of a pressure chamber of the piezo-electric type page width inkjet printhead, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
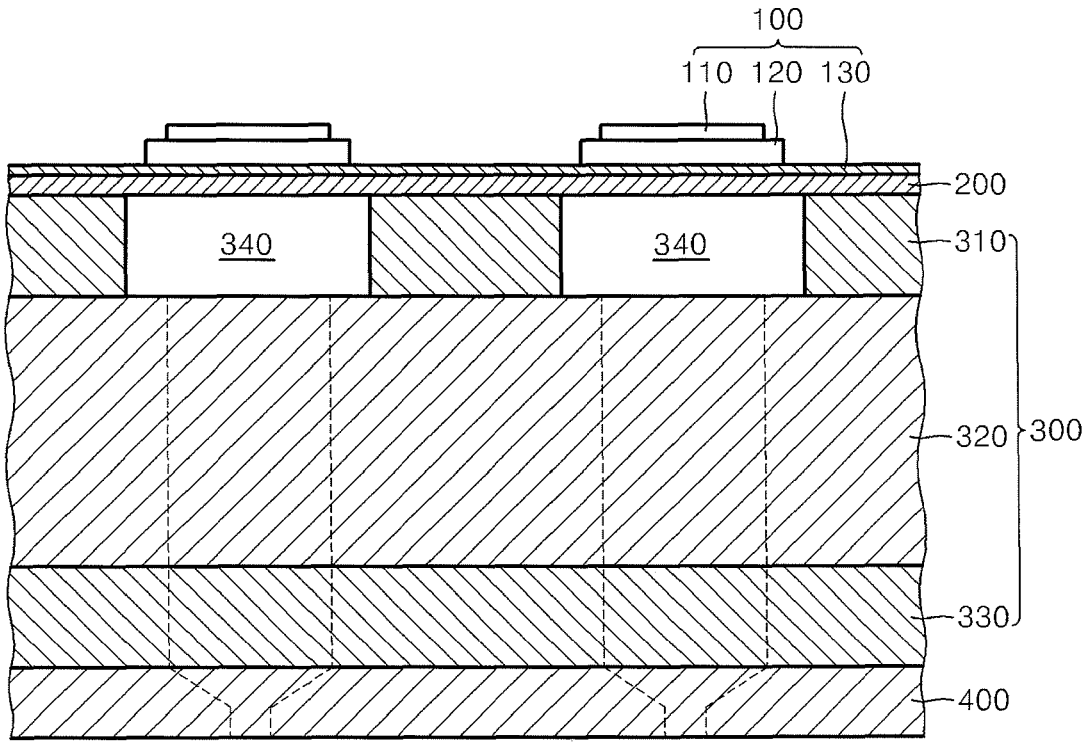
FIG. 2 is a cross-sectional view illustrating the piezo-electric type page width inkjet printhead taken along line A-A of FIG. 1.

FIG. 1 is a cross-sectional view illustrating a piezo-electric type page width inkjet printhead taken along a lengthwise direction of a pressure chamber 340 thereof, according to an embodiment of the present general inventive concept. FIG. 2 is a cross-sectional view illustrating the piezo-electric type page width inkjet printhead taken along line A-A of FIG. 1.

Figure 3:
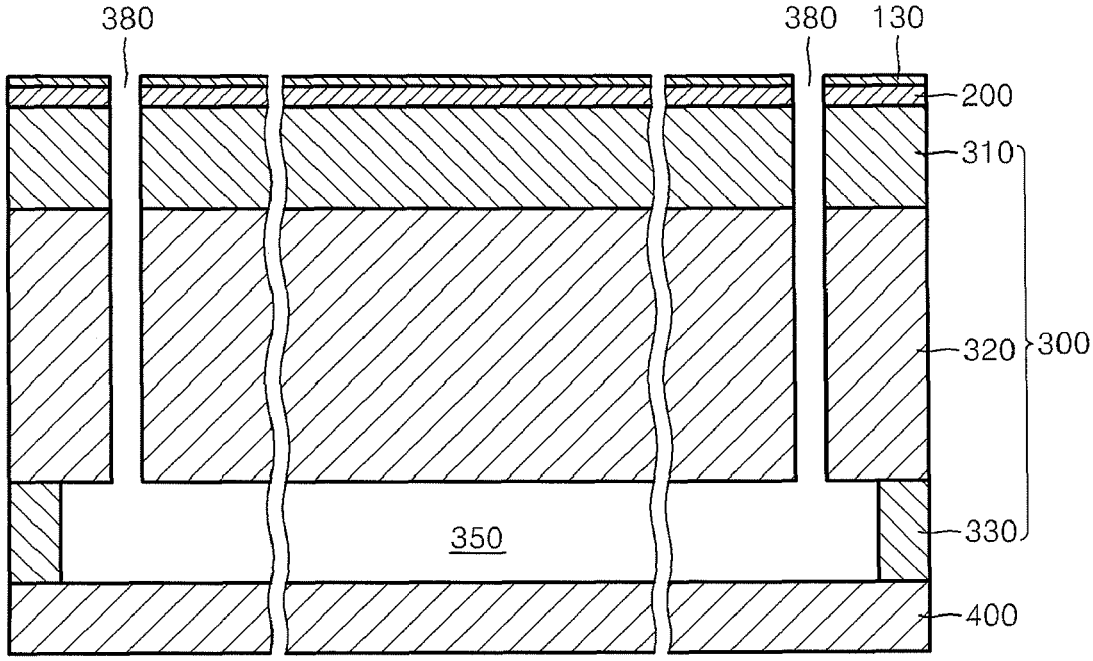
FIG. 3 is a cross-sectional view illustrating the piezo-electric type page width inkjet printhead taken along line B-B of FIG. 1.

FIG. 3 is a cross-sectional view illustrating the piezo-electric type page width inkjet printhead taken along line B-B of FIG. 1.

Referring to FIGS. 1, 2, and 3, the piezo-electric type page width inkjet printhead is configured by stacking and attaching upper, intermediate, and lower substrates 200, 300 and 400. The elements constituting an ink flow channel are formed in each of the upper, intermediate, and lower substrates 200, 300 and 400. A piezoelectric actuator 100 is disposed on the upper substrate 200 to generate a driving power to eject ink. In particular, the elements constituting the ink flow channel can be minutely and easily formed in the upper, intermediate, and lower substrates 200, 300 and 400, respectively, by using micromachining technology such as photolithography and etching.

The ink flow channel includes a manifold 350 to store ink that flows through an ink entrance hole 380 from an ink container (not illustrated), a restrictor 360 that provides ink from the manifold 350 to a pressure chamber 340 that is filled with ink that is to be ejected and varies in pressure in order to eject the ink, and a nozzle 410 through which ink is ejected. A damper 370 is formed between the pressure chamber 340 and the nozzle 410, and the damper 370 concentrates energy generated by the pressure chamber 340 towards the nozzle 410 due to the piezoelectric actuator 100 and buffs remarkable pressure change. The elements constituting the ink flow channel are separated so as to be respectively disposed in each of the upper, intermediate, and lower 200, 300 and 400, as described above.

The upper substrate 200 is disposed on the intermediate substrate 300, and constitutes an upper wall of the pressure chamber 340. The upper substrate 200 is deformed and bent due to the piezoelectric actuator 100, and thus, the upper substrate 200 functions as a diaphragm that changes the volume of the pressure chamber 340, and the upper substrate 200 is a single crystal silicon wafer that is widely used for manufacturing integrated circuits. In particular, although not illustrated, the upper substrate 200 may be a silicon-on-insulator (SOI) wafer having a stack structure including a first silicon substrate, an inter-oxide layer formed on the first silicon substrate, and a second silicon substrate adhered onto the inter-oxide layer. The first silicon substrate is formed of silicon single crystal, and has a thickness of about several hundreds of μm. The inter-oxide layer is formed by oxidizing a surface of the first silicon substrate, and has a thickness in the range of about 1 to 2 μm. The second silicon substrate is formed of silicon single crystal, and has a thickness of about several tens of μm The piezoelectric actuator 100 is disposed on the upper substrate 200, and the piezoelectric actuator 100 includes a lower electrode 130 that functions as a common electrode, a piezoelectric film 120 that deforms according to an applied voltage, and an upper electrode 110 that functions as a driving electrode. The piezoelectric film 120 is formed on the lower electrode 130, and is disposed just above the pressure chamber 340, and the piezoelectric film 120 is deformed by an applied voltage, so as to bend the upper substrate 200, which constitutes the upper wall of the pressure chamber 340, that is, the diaphragm. The upper electrode 110 is formed on the piezoelectric film 120, and functions as the driving electrode that applies a voltage to the piezoelectric film 120. In addition, a silicon oxide layer (not shown) that functions as an insulating layer may be formed between the upper substrate 200 and the piezoelectric actuator 100.

The intermediate substrate 300 is an aspect of the present invention in that the intermediate substrate 300 is a both-sided copper clad laminate plate including a laminate plate 320, an upper copper film 310 formed on the laminate plate 320, and a lower copper film 330 on which the laminate plate 320 is formed. The pressure chamber 340, which constitutes a predetermined space formed by patterning and removing a part of the upper copper film 310 of the intermediate substrate 300, is formed in the upper copper film 310, and the pressure chamber 340 is formed above the laminate plate 320.

The lower and upper copper films 330 and 310 may be formed of a material of copper or a compound including copper. The laminate plate 320 and the lower and upper copper films 330 and 310 may be attached to each other according to an attaching process. For example, a bonding material can be applied between the laminate plate 320 and the lower and upper copper films. The attaching process may be a conventional process to attach a laminate plate and a film to each other. The present general inventive concept is not limited thereto. Other attaching process can be used to attach or combine the laminate plate 320 and the lower and upper copper films 330 and 310.

The manifold 350 is formed in a lower portion of the intermediate substrate 300, and the manifold 350 stores ink that flows through the ink entrance hole 380 from an external cartridge (not shown). The manifold 350 is formed so as to occupy a predetermined space in the lower copper film 330 and a portion of the laminate plate 320 of the intermediate substrate 300, and the manifold 350 and one end of the pressure chamber 340 are connected by the restrictor 360 that is formed through the laminate plate 320 in a Y direction, which is in a perpendicular direction to a lengthwise direction (X direction) of the pressure chamber 340. The damper 370, which is formed in the Y direction through the intermediate substrate 300, is formed on a portion of the intermediate substrate 300, which corresponds to the other end of the pressure chamber 340. The restrictor 360 and the damper 370 are parallel to each other in the Y direction, and the restrictor 360 prevents ink from flowing back into the manifold 350 from the pressure chamber 340 when ink is ejected, and also function as a path supplying ink from the manifold 350 to the pressure chamber 340. In order to prevent ink from flowing back into the manifold 350, the cross section of the restrictor 360 may be much smaller than each of those of the pressure chamber 340 and the damper 370.

The nozzle 410 is formed through the lower substrate 400 on a portion of the lower substrate 400, which corresponds to the damper 370. The nozzle 410 includes an ink ejecting hole 412 formed in a lower portion of the lower substrate 400, and an ink leading unit 411 formed in an upper portion of the lower substrate 400. Ink is ejected through the ink ejecting hole 412. The ink leading unit 411 connects the damper 370 to the ink ejecting hole 412, and pressurizes and leads ink from the damper 370 towards the ink ejecting hole 412. The ink ejecting hole 412 is a hole in the Y direction having a predetermined diameter. The ink leading unit 411 has a shape of a circular cone of which a cross section gradually decreases from the damper 370 towards the ink ejecting hole 412.

The operation of the piezo-electric type page width inkjet printhead having the above structure will be described.

Ink that flows from an ink cartridge (not shown) to the inside of the manifold 350 is supplied to the inside of the pressure chamber 340 through the restrictor 360. When the pressure chamber 340 is filled with ink, a voltage is applied to the piezoelectric film 120 through the upper electrode 110 of the piezoelectric actuator 100, and thereby, deforming the piezoelectric film 120, and accordingly, the upper substrate 200 that functions as a diaphragm is bent downward towards the pressure chamber 340. As such, the volume of the pressure chamber 340 is reduced due to the bending and deformation of the upper substrate 200, and accordingly, the ink filling the pressure chamber 340 passes into the damper 370 and is ejected through the nozzle 410 to the outside due to the rise in pressure inside of the pressure chamber 340.

When the upper substrate 200 returns to its original position, the volume of the pressure chamber 340 is increased, and simultaneously, the ink stored in the manifold 350 flows into the pressure chamber 340 through the restrictor 360.

The operation of deforming the piezoelectric actuator 100 so as to bend the upper substrate 200 can be repeated to eject ink.

Figure 4:
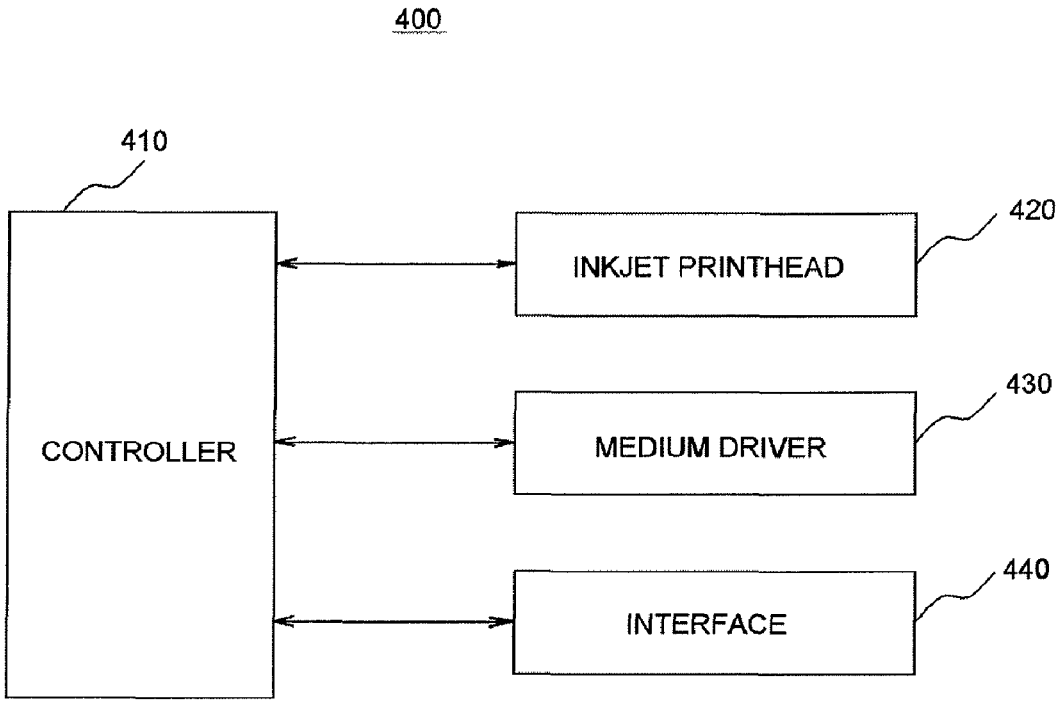
FIG. 4 is a view illustrating an image forming apparatus according to an exemplary embodiment of the present general inventive concept.

FIG. 4 is a view illustrating an image forming apparatus 400 according to an exemplary embodiment of the present general inventive concept. Referring to FIGS. 1 and 4, the image forming apparatus 400 includes a controller 410, an inkjet printhead unit 420, a medium driver 430, and an interface 440. The inkjet printhead unit 420 may include the piezo-electric type page width inkjet printhead of FIG. 1, and may also include a driver to drive actuators of the piezo-electric type page width inkjet printhead to eject ink through corresponding nozzles. The medium driver 430 includes a feeding unit to pick up and feed a printing medium toward the piezo-electric type page width inkjet printhead of the inkjet printhead unit 420, and a discharging unit to discharge the printing medium to an outside of the image forming apparatus 400.

The medium driver 430 includes a feeding unit to pick up and feed a printing medium toward the piezo-electric type page width inkjet printhead of the inkjet printhead unit 420, and a discharging unit to discharge the printing medium to an outside of the image forming apparatus 400. The interface 440 communicates with an external device to receive information corresponding to the printed image and operation of the controller to print the image on the print medium. The controller 410 controls operations of the inkjet printhead unit 420, the medium driver 430, and the interface 440. Conventional medium driver and interface may be used as the medium driver 430 and the interface 440, respectively.

As described above, the both-sided copper clad laminate (CCL) plate is used in the piezo-electric type page width inkjet printhead according to the present invention, and thus, a large-area process can be realized and manufacturing costs can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents

What is claimed is:

1. A piezo-electric type page width inkjet printhead comprising:

an intermediate substrate comprising a pressure chamber to be filled with ink to be ejected, a manifold connected to an ink entrance hole to store ink that flows in through the ink entrance hole, a restrictor to connect the manifold to one end of the pressure chamber, and a damper formed through the intermediate substrate corresponding to the other end of the pressure chamber;

a lower substrate comprising a nozzle formed through a portion of the lower substrate, which corresponds to the damper, to eject ink;

an upper substrate formed on the intermediate substrate to seal an upper side of the pressure chamber; and a piezoelectric actuator formed on the upper substrate to generate a driving power to the pressure chamber to eject the ink through the nozzle, wherein the intermediate substrate comprises a both-sided copper clad laminate plate comprising an upper copper film and a lower copper film that are respectively formed on top and bottom surfaces of the laminate plate.

2. The inkjet printhead of claim 1, wherein the pressure chamber is formed by patterning a portion of the upper copper film, and is formed above the laminate plate.

3. The inkjet printhead of claim 2, wherein the restrictor is formed through the laminate plate.

4. The inkjet printhead of claim 3, wherein the restrictor is formed vertically through the laminate plate so as to be parallel to the damper.

5. The inkjet printhead of claim 1, wherein the restrictor is formed through the laminate plate.

6. A piezo-electric type page width inkjet printhead comprising:

a lower substrate having a nozzle;

an intermediate substrate having an ink flowing channel and formed of a both-sided copper clad laminate plate comprising a laminate plate and an upper copper film and a lower copper film that are respectively formed on top and bottom surfaces of the laminate plate;

an upper substrate; and a piezoelectric actuator formed on the upper substrate to generate a driving power to the ink flowing channel to eject the ink through the nozzle.

7. The inkjet printhead of claim 6, wherein:

the laminate plate is formed of a first material;

the upper copper film and the lower copper film are formed of a second material; and the ink flowing channel comprises a manifold, a restrictor, a pressure chamber, and a damper which are formed in corresponding ones of the laminate plate, the upper copper film, and the lower copper film.

8. The inkjet printhead of claim 6, wherein:

the laminate plate is formed of a first material;

the upper copper film and the lower copper film are formed of a second material; and the upper substrate and the lower substrate are formed of a third material different from the first material and the second material.

9. The inkjet printhead of claim 6, wherein:

the nozzle comprises a plurality of nozzles formed in the lower substrate;

the piezoelectric actuator comprises a plurality of piezoelectric actuators formed on the upper substrate; and the ink flowing channel comprises a plurality of ink flowing channels formed in the laminate plate, the upper copper film, and the lower copper film of the intermediate substrate and disposed between corresponding ones of the plurality of nozzles and the plurality of piezoelectric actuators.

10. The inkjet printhead of claim 6, wherein:

the ink flowing channel comprises a pressure chamber; and the upper copper film is disposed between the laminate plate and the upper substrate to define the pressure chamber with the upper substrate and the laminate plate.

11. The inkjet printhead of claim 6, wherein:

the ink flowing channel comprises a pressure chamber; and the upper copper film is disposed between the laminate plate and the upper substrate and includes a cutout portion to correspond to the pressure chamber.

12. The inkjet printhead of claim 6, wherein:

the ink flowing channel comprises a damper; and the laminate plate comprises a cutout portion to correspond to the damper.

13. The inkjet printhead of claim 6, wherein:

the ink flowing channel comprises a restrictor; and the laminate plate comprises a cutout portion to correspond to the restrictor.

14. The inkjet printhead of claim 6, wherein:

the ink flowing channel comprises a manifold;

the laminate comprises a first cutout portion; and the lower copper film comprises a second cutout portion to define the manifold with the first cutout portion.

15. An image forming apparatus comprising:

an inkjet printhead unit having a lower substrate having a nozzle, an intermediate substrate having an ink flowing channel and formed of a both-sided copper clad laminate plate comprising a laminate plate, an upper copper film and a lower copper film that are respectively formed on top and bottom surfaces of the laminate plate, an upper substrate formed on the intermediate substrate, and a piezoelectric actuator formed on the upper substrate to generate a driving power to the ink flowing channel to eject the ink through the nozzle;

a medium driver to feed a printing medium toward the inkjet printhead unit; and a controller to control the inkjet printhead unit and the medium driver to form an image on the fed printing medium.

* * * * *